US010450180B2

(12) United States Patent
Ploeger

(10) Patent No.: US 10,450,180 B2
(45) Date of Patent: Oct. 22, 2019

(54) MULTI-APPLICATION OIL FUNNEL CONSTRUCTION FOR REFILLING CRANKCASES THROUGH A FILLING PORT

(71) Applicant: Lisle Corporation, Clarinda, IA (US)

(72) Inventor: Randall J. Ploeger, Clarinda, IA (US)

(73) Assignee: Lisle Corporation, Clarinda, IA (US)

( * ) Notice: Subject to any disclaimer, the term of this patent is extended or adjusted under 35 U.S.C. 154(b) by 34 days.

(21) Appl. No.: 15/685,579

(22) Filed: Aug. 24, 2017

(65) Prior Publication Data

US 2018/0057335 A1 Mar. 1, 2018

Related U.S. Application Data

(60) Provisional application No. 62/379,081, filed on Aug. 24, 2016.

(51) Int. Cl.
*B67C 11/02* (2006.01)

(52) U.S. Cl.
CPC ..... *B67C 11/02* (2013.01); *B67C 2011/027* (2013.01)

(58) Field of Classification Search
CPC ..... B67C 11/02; B67C 2011/027
See application file for complete search history.

(56) References Cited

U.S. PATENT DOCUMENTS 3,939,884 A * 2/1976 Mader ..... B67C 11/02 141/333
D244,027 S 4/1977 Mooney et al.
4,126,557 A 11/1978 Hodgkins
4,130,147 A * 12/1978 Langlie ..... B67C 11/02 141/333
4,600,125 A † 7/1986 Maynard
D332,481 S 1/1993 Petty et al.
5,626,174 A * 5/1997 Schaffner ..... B67C 11/02 141/332
5,685,351 A † 11/1997 Kazarian
D396,006 S 7/1998 Harris
D439,663 S 3/2001 Guala
(Continued)

OTHER PUBLICATIONS

Snap-On, Kit, Master Oil Funnel, 5 pc., #OFKIT, <https://store.snapon.com/Funnels-Spouts-Kit-Master-Oil-Funnel-5-pc-P812978.aspx>, May 18, 2016.

(Continued)

*Primary Examiner* — Nicolas A Arnett
(74) *Attorney, Agent, or Firm* — Banner & Witcoff, Ltd.

(57) ABSTRACT

A tool kit comprised of multiple components from which select components may be assembled to provide a customized funnel construction with an adapter matched to a crankcase filling port of an internal combustion engine. Selective components of the kit may be arranged to provide an efficient and easily assembled oil filing device which provides improved access to crankcase filling ports of internal combustion engines. The components can easily be rearranged depending upon the design of the filling port of engine which is being serviced. The kit includes a common funnel section, one or more unique nozzle sections which in combination are compatible with two or more distinct unique adapters. This combination enables the use of a funnel of universal design for and with adapters of distinct design.

4 Claims, 6 Drawing Sheets

(56) References Cited

U.S. PATENT DOCUMENTS

| | | | | |
|---|---|---|---|---|
| 6,340,038 | B1 † | 1/2002 | Ingram | |
| 6,752,183 | B2 * | 6/2004 | Leoncavallo | B65B 39/00 141/331 |
| D513,180 | S | 12/2005 | Lindsey et al. | |
| D543,947 | S † | 6/2007 | Phung | |
| D554,067 | S | 10/2007 | Phung et al. | |
| 7,284,581 | B2 * | 10/2007 | Steinweg | B67C 11/04 141/331 |
| D594,395 | S | 6/2009 | Yoshii | |
| D601,964 | S | 10/2009 | Rupp et al. | |
| D623,062 | S | 9/2010 | Gullickson et al. | |
| D659,100 | S | 5/2012 | Deiss | |
| D682,690 | S | 5/2013 | Bowes | |
| 8,622,100 | B2 * | 1/2014 | Levy | B67C 11/02 141/342 |
| D712,014 | S | 8/2014 | Guest | |
| D719,961 | S | 12/2014 | Xiang et al. | |
| D739,493 | S | 9/2015 | Wyne | |
| D752,719 | S | 3/2016 | Lehmann | |
| D756,760 | S | 5/2016 | Fay, II | |
| 9,416,698 | B2 | 8/2016 | Meeks et al. | |
| D770,266 | S | 11/2016 | Tar et al. | |
| D777,565 | S | 1/2017 | Yeh | |
| D785,789 | S | 5/2017 | Turturro et al. | |
| D803,045 | S | 11/2017 | Ploeger | |
| D803,046 | S | 11/2017 | Ploeger | |
| D803,047 | S | 11/2017 | Ploeger | |
| D803,048 | S | 11/2017 | Ploeger | |
| D803,049 | S | 11/2017 | Ploeger | |
| D803,050 | S | 11/2017 | Ploeger | |
| D804,945 | S | 12/2017 | Ploeger | |
| D811,303 | S | 2/2018 | Calfee | |
| D828,751 | S | 9/2018 | Ploeger | |
| D828,752 | S | 9/2018 | Ploeger | |
| 2003/0106609 | A1 * | 6/2003 | Leoncavallo | B65B 39/00 141/340 |
| 2006/0108022 | A1 * | 5/2006 | Carter | B65B 39/12 141/340 |
| 2011/0100985 | A1 | 5/2011 | Tsiberidis | |
| 2012/0267006 | A1 † | 10/2012 | Liao | |
| 2016/0070072 | A1 | 3/2016 | Penumatcha et al. | |

OTHER PUBLICATIONS

CTA Manufacturing Corp., 10 pc. Oil Filling System with Universal Funnel, #7480, www.ctatools.com <http://www.ctatools.com>, 2015.

Assenmacher Specialty Tools posted by AST posted date Jul. 14, 2014, © Vehicle Service Pros, [online], [site visited May 22, 2017]. Available from Internet, http://www.vehicleservicepros.com/directory/oil-and-lubeequipment!fu nnels/product/11574219/assenmacher -specialty-tools-ast -6pc-custom-oi 1-fu nnel-set -no-fun 14kit.

Lisle's Multi-Application Oil Funnel Helps Eliminate Oil Spills posted by Tech Shop Writers posted date Oct. 13, 2015, © Tech Shop, [online], [site visited May 24, 2017]. Available from Internet, http://www.techshopmag.com/lisles-multi-application-oilfunnel-helps-eliminate-oil-spills/.

19342 Multi-Application Oil Funnel posted by Lisle Corporation posted date Sep. 24, 2015, © YouTube, [online], [site visited May 24, 2017]. Available from Internet, https://www.youtube.com/watch?v=CwfsRo2uVo8.

Lis19342 Multi Application Oil Funnel posted by Eppy Tool & Equipment posted date May 11, 2016, © YouTube, [online], [site visited May 24, 2017]. Available from Internet, https://www.youtube.com/watch?v=CwfsRo2uVo8.

19342 Multi Application Oil Funnel Overview Tutorial posted by JEGS Performance posted date Jul. 21, 2016, © YouTube, [online], [site visited May 24, 2017]. https://www.youtube.com/watch?v=MFSLstHtENQ.

Oil Funnel Kit, No. OFKIT posted by Snap on Inc. posted date Mar. 30, 2015, © Vehicle Service Pros, [online], [site visited May 24, 2017]. http://www.vehicleservicepros.com/directory/oil-and-lube-equipment/product/12059826/snapon-inc-oil-funnel-kit-noofkit.

Oil Filling System posted by CTA Manufacturing Corp. posted date Jul. 22, 2015, © Vehicle Service Pros, [online], [site visited May 22, 2017]. Available from Internet, http://www.vehicleservicepros.com/directory/oil-and-lube-equipment/oil-changeequ ipment!product/12095086/cta-manufactu ring-corp-1 Opc-oi 1-filling-system-with-u n iversal-fu n nel-no-7480.

https://www.amazon.com/Lisle-19342-Multi%20-App-Funnel/dp/B016QB9Q56/ref=sr_1_cc_1?s=aps&ie=%20UTF8&qid=1537338240&sr=1-1-catcorr&keywords=Lisle%20+19342+Multi+App+Oil+Funnel+Set.† https://www.amazon.com/dp/B01I40ZQWE/ref=psdc_15708811_t2_B072BWG5GF.†

* cited by examiner
† cited by third party

FIG.1
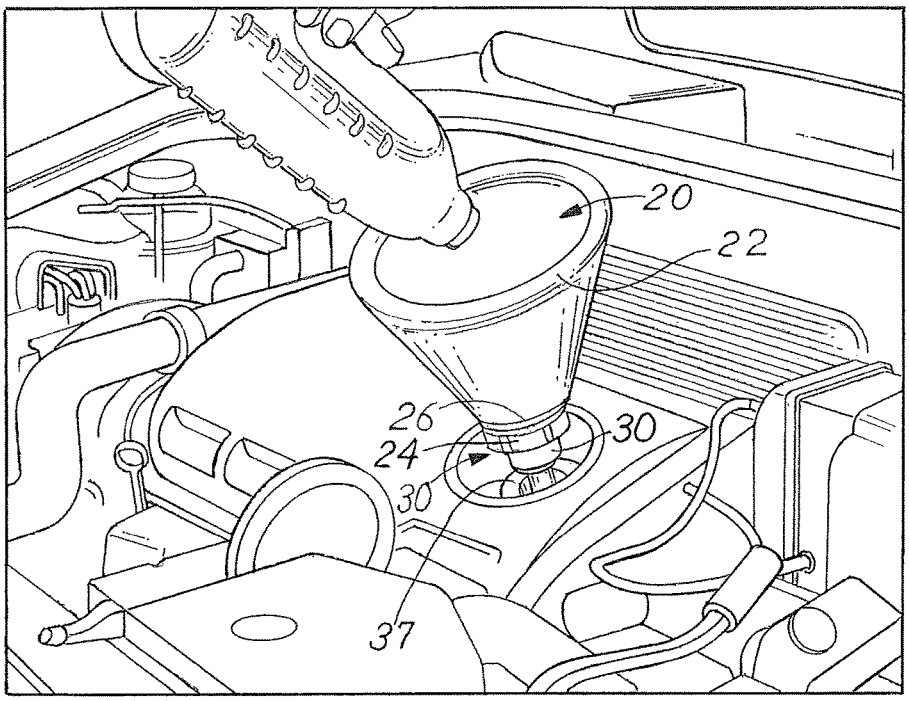
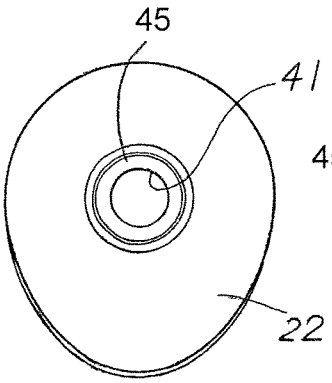
FIG 2B
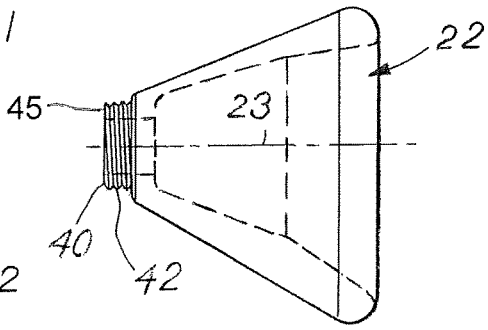
FIG.2A
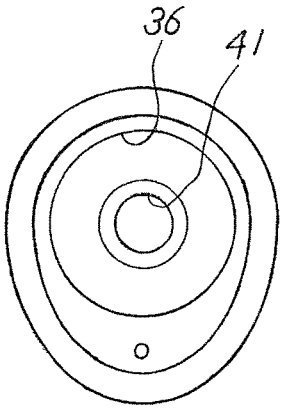
FIG.2C

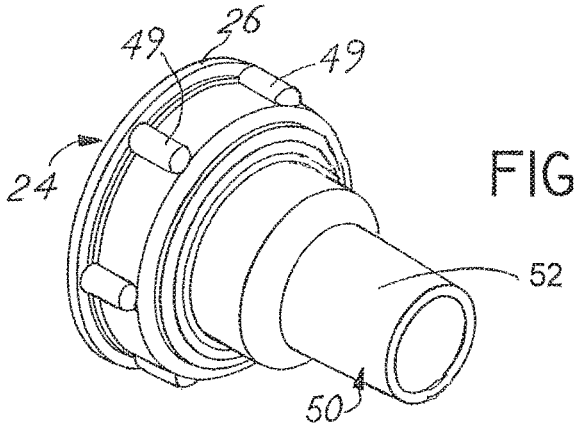
FIG. 3A
FIG.3C
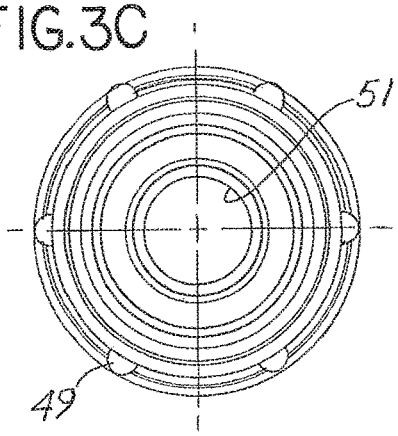
FIG.3B
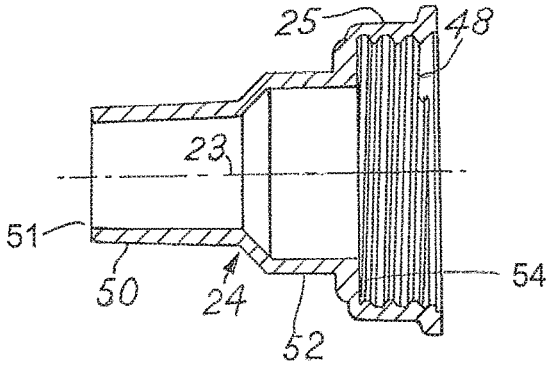
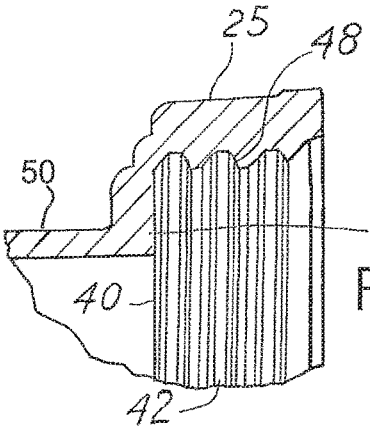
FIG.3D

FIG.4E
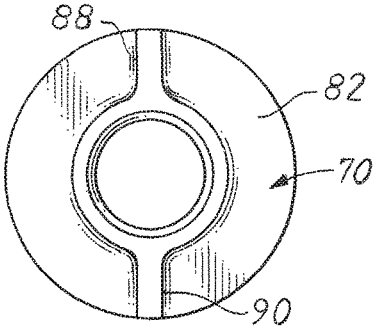
FIG.4D
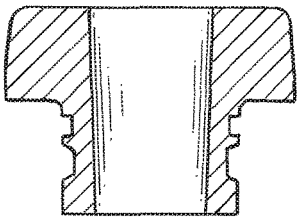
FIG.4A
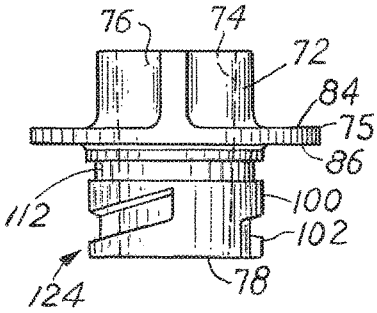
FIG.4B
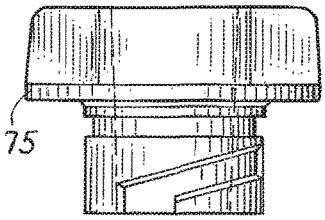
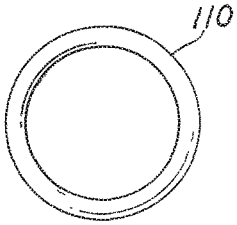
FIG.4F
FIG.4C
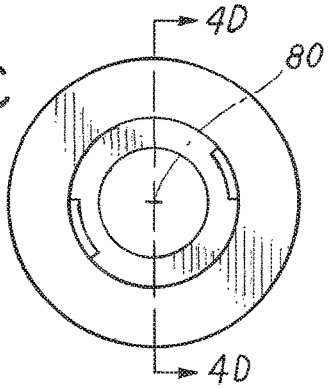

FIG. 5E
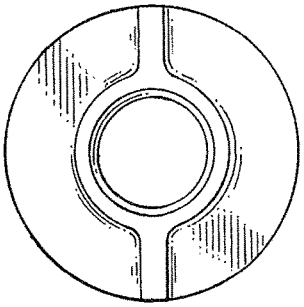
FIG. 5D
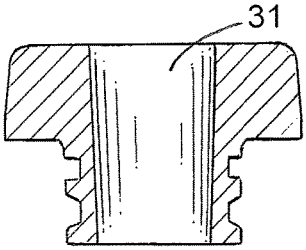
FIG. 5A
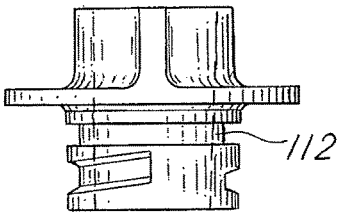
FIG. 5B
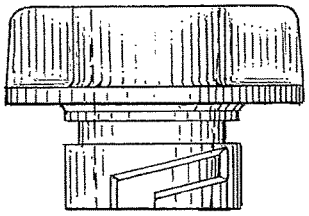
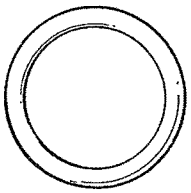
FIG. 5F
FIG. 5C
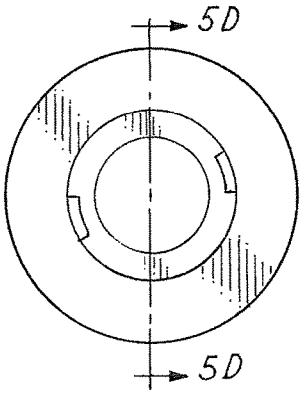

FIG.6B
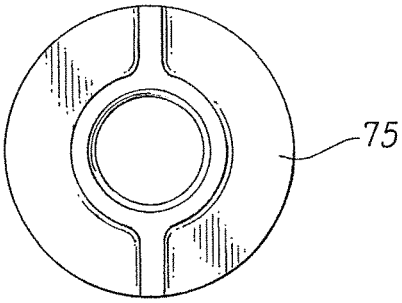
FIG.6C
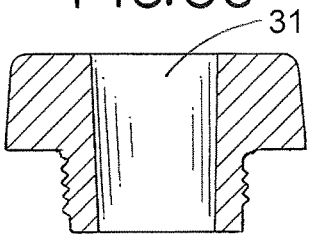
FIG.6A
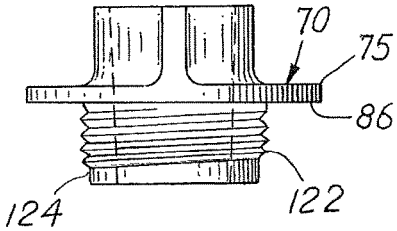
FIG.6E
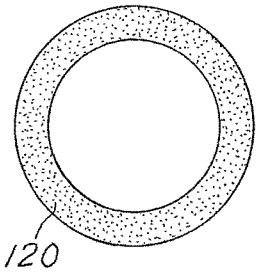
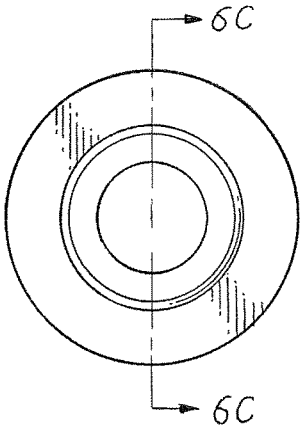
FIG.6D FIG.7A
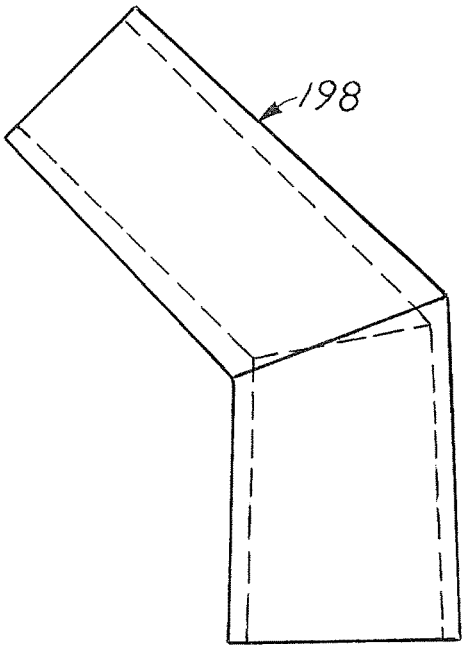
FIG.7B
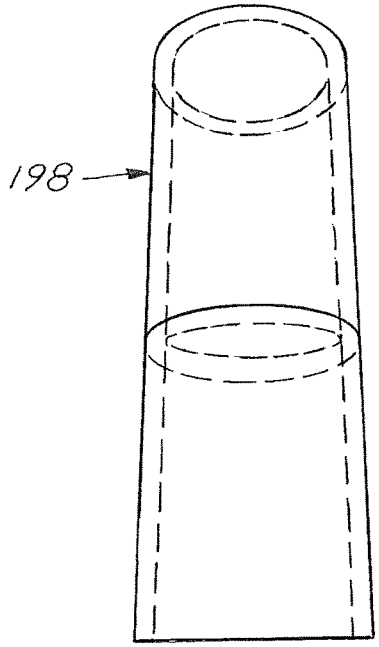
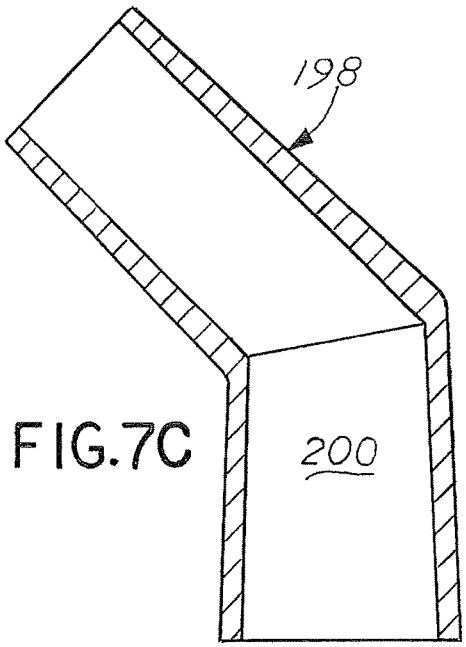
FIG.7C

MULTI-APPLICATION OIL FUNNEL CONSTRUCTION FOR REFILLING CRANKCASES THROUGH A FILLING PORT

CROSS REFERENCE TO RELATED APPLICATION

This is a utility application based on provisional application Ser. No. 62/379,081 filed Aug. 24, 2016 entitled "Multi-Application Oil Funnel Construction for refilling Crankcases Through a Filling Port" for which priority is claimed.

BACKGROUND OF THE INVENTION

In a principal aspect the present invention relates to a kit comprised of multiple components that may be combined in multiple configurations to enable an auto mechanic or technician to fill without spilling the filling port of an oil crankcase of an internal combustion engine.

Heretofore when repairing internal combustion engines or otherwise servicing such engines, the oil in the crankcase is often drained and replaced. Various devices have been utilized by technicians to facilitate oil replacement. For example, funnels having various features have been used to facilitate filling the crankcase through a filling port. Such an operation is somewhat challenging since spills often occur and leakage of the oil during the filling operation is undesirable. Further, many of the filling ports of modern vehicles are not easily accessed. Additionally, the internal combustion engines of various models of vehicles employ unique designs and fittings associated with the crankcase filling ports again providing a challenge to a mechanic or service technician seeking to replace the oil in the crankcase.

SUMMARY OF THE INVENTION

Briefly the present invention comprises a kit of multiple components from which select components may be assembled to provide a customized funnel construction with an adapter matched to a crankcase filling port of an internal combustion engine. That is, selective component parts of the kit may be arranged to provide a very efficient and easily assembled oil filing device which provides improved access to crankcase filling ports of internal combustion engines. The arrangement of kit components can easily be modified depending upon the design of the filling port of engine which is being serviced.

Thus, an object of the invention is to provide a kit of components which enable easy filling of oil crankcases by accommodating the design of various filling ports for engine crankcases.

It is another object, advantage and feature of the invention to provide an oil filling kit and system which incorporates a minimum number of component parts that may be assembled quickly and easily thereby saving time and cost associated with filling an engine crankcase.

Another object, advantage and feature of the invention is to provide a system which enhances the sealing and flow of oil being directed into a crankcase particularly a crankcase which utilize baffle valve covers and which are not easily accessed.

These and other objects, advantages and features of the invention are set forth in the detailed description which follows.

BRIEF DESCRIPTION OF THE DRAWINGS

In the detail description reference will be made to the drawing comprised of the following Figures:

FIG. 1 is a perspective view of the component parts of an assembled oil filling kit construction including a funnel construction having a large frustoconical open ended funnel section with a separate, detachable discharge nozzle outlet section associated with and coupled to a unique adapter from the kit which is uniquely associated with the design and construction of specific filling port configurations;

FIGS. 2A, 2B and 2C comprise a series of drawings depicting the funnel section of the funnel construction kit wherein FIG. 2A is a side elevation, FIG. 2B is a left end elevation and FIG. 2C is a right end elevation;

FIGS. 3A, 3B and 3C are a series of views of the nozzle section uniquely compatible with the funnel section of FIGS. 2A, 2B, 2C and also with a series or set of adapters depicted in the remaining Figs.;

FIG. 3D is a partial sectional view of a nozzle section joined to a funnel section;

FIGS. 4A-4F, 5A-5F, 6A-6E and 7A-7C depict multiple unique, separate adapter constructions which may be utilized in combination with the nozzle section of the funnel construction wherein each of the separate adapters is capable of being removably attached to the nozzle section in a manner which ensures a seal of the fluid pathway through the funnel construction and an adapter into a filling port. The adapter includes in each instance a unique configuration associated with a specific design of a filling port.

DETAILED DESCRIPTION OF AN EMBODIMENT OF THE INVENTION

Referring to FIG. 1, the component parts of the kit of an embodiment of the invention are depicted. FIG. 1 also illustrates the method of use of the invention. Thus, a funnel construction 20 having a generally frustoconical configuration is comprised of a funnel section 22 is coupled with and thereby integrated with a nozzle section 24. The funnel section 22 and the nozzle section 24 are joined along an intersection or boundary 26 (See FIG. 3A). The funnel section 22 is designed to receive a quantity of oil through a top funnel section opening 36. The oil in the funnel section 22 will ultimately be discharged or drain through nozzle section 24 and a select adapter 30 into a filling port 37 for a crankcase of an internal combustion engine.

In the embodiment depicted the funnel section 22 and the nozzle section 24 are separate component parts. The component parts are joined together by a fastening assembly at intersection 26 and in combination provide a smooth oil flow path through the tubular nozzle section 24 from the funnel section 22. The component parts; namely, the funnel section 22 and the nozzle section 24 are typically coupled together by means of internal threads 48 in threaded cap 25 of nozzle section 24 which are threaded on external surface threads 42 (FIG. 2A) at the outlet end of the funnel section 22 to retain nozzle section 24 aligned axially along axis 23 of funnel section 22 (see FIG. 3B). Thus the funnel section 22 and the nozzle section 24 are axially aligned to facilitate the smooth flow of oil through the funnel section bottom opening 41 so that oil will flow axially from funnel section 22 into and through nozzle section 24.

The funnel construction 20 thus is comprised of component parts which may be maintained consistently in the described configuration with respect to use and are available for use in combination with additional component parts of the kit; namely, a series or set of adapters 30 such as shown in FIGS. 4, 5, 6 and 7. A series of such adapters 30 (described hereinafter) are thus used in combination with the nozzle section of funnel construction 20 to provide a useful combination designed to be specifically associated with a chosen set of compatible adapters 30 for filling ports associated with a variety of filling ports of internal combustion crankcase design. The connection between the funnel construction 20 and an adapter 30 is designed to provide a sealing relationship wherein oil will not flow or spill from the connection, but further wherein the connection may be easily detached so that, for example, a substitute nozzle section 24 and/or set of adapters 30 may be combined with the same or a distinct, compatible nozzle section 24.

The adapters 30 in a set are thus generic in functional design with respect to the interconnection between the funnel construction 20, including the appropriate nozzle section 24 and set of adapters 30. However, each adapter 30 is, in effect, unique in other respects; namely, with respect to the construction or coupling of the adapter 30 to a filling port. That is, the adapters 30 are each uniquely associated with the filling port of a particular internal combustion engine crankcase because filling ports may be uniquely designed having distinct configurations and baffles incorporated therewith. As a consequence, the funnel construction 20 which includes a compatible nozzle section 24 for a set of adapters may be used with any of a series or set of compatible adapters 30 having a common adapter inlet. The funnel construction 20 including a particular generic outlet nozzle section 24 may thus be coupled with members of a set of adapters 30, each of which has an inlet designed to be compatible in all circumstances with a nozzle section 24 outlet. However, each of the adapters 30 themselves may have an outlet compatible only with a certain filling port 37.

In use therefore, an outlet of an adapter 30 outlet is positioned on or coupled to a filling port 37 which is compatible. An outlet nozzle 50 of nozzle section 24 which is attached to funnel section 22 is connected to the inlet of the adapter 30. The funnel section 22 coupled with a nozzle section 24 is thus engaged with an inlet opening of an adapter. Subsequently, lubricating oil placed in funnel section 22 is directed from the funnel construction 20 through the funnel section 22 and nozzle section 24 outlet of nozzle 50 which is compatible with and fitted into the inlet of one adapter 30 and then into the filling port 37 of an engine crankcase.

FIGS. 2A, 2B, 2C and 3A, 3B, 3C are thus directed to the two component part, funnel construction 20. Referring therefore to FIGS. 2A-2C, the funnel section 22 of the funnel construction 20 is generally frustoconical having an open top side defining a fill opening 36. The top side of funnel section 22 and the opening 36 thereof are generally coaxial along axis 23. The bottom side 40 of the funnel section 22 includes a bottom opening 41, a threaded cylindrical section with external threads 42 which are compatible with threads 48 of a nozzle section 24 cylindrical section 25 depicted in FIGS. 3B, 3C, 3D. The nozzle section 24 thus includes an internally threaded cylindrical fitting 25 comprising an intersection with threads 48 that are compatible with threads 42 of the outlet end of cylindrical funnel section 22. The threaded interaction of the threads 48 of the nozzle section 24 and threads 42 of the funnel section 22 thus provide a smooth internal intersection 26 which enables the funnel construction 20 to terminate with a separate cylindrical nozzle of nozzle section 24.

As depicted in FIG. 3D, an inlet circular axially transverse surface 54 of nozzle section 24 at the inlet threaded end of nozzle section 24 provides a seal against an axially transverse flange 45 of funnel section 22. The seal is facilitated by the construction of the nozzle section cap 25 which is sufficiently elongate axially to be threaded tightly in a manner which engages the surfaces 45 and 54 (FIG. 3D).

Outlet nozzle 50 of nozzle section 24 is coaxial with the axis 23. The nozzle 50 of nozzle section 24 is sufficiently elongate to provide an outer face or surface 52 which is generally frustoconical and has an outer end 51. The nozzle outlet section 50 outer surface 52 has a frustoconical shape with a narrow end 54 which is pitched inwardly toward the axis 23. The angle of pitch is uniform and is in the range of 2° to 5° in the axial direction with a preferred angle being about a 3.5° pitch inwardly toward axis 23. Typically, the pitch of surface 50 is compatible with the inlets 31 of a set of adapters 30.

FIGS. 4A-F, 5A-F and 6A-E depict a series or set of adapters 30 which may be used in combination with the funnel construction 20.

Referring to FIGS. 4A-E, by way of example, there is depicted a specific adapter construction. The adapters 30, which are utilized in combination with the funnel construction 20, have multiple common features. However, each adapter 30 in the series also has a unique aspect differentiating one adapter 30 from the next.

Referring to FIGS. 4A-E there is depicted a specific adapter 70. This adapter 70 has multiple features which are common to all of the other adapters. The adapter 70 includes a body section 72 with a generally cylindrical throughbore 74. The throughbore 74 includes an inlet 76 and an outlet 78. The throughbore 74 further is defined by a centerline axis 80 which serves as an axis of symmetry for various features of the adapter 70. The throughbore 74 inlet may have a frustoconical configuration with the interior surface of the throughbore 74 toward the outlet end 78 having a lesser radius than the throughbore at the inlet end 76. The frustoconical configuration comprises a pitch angle which is substantially identical but inverse to the pitch angle previously described with respect to the nozzle 50 of the nozzle section 24. It is wide at the inlet 76 side and narrows toward the outlet 78. This may be an important feature inasmuch as the nozzle 50 is designed to be inserted into the throughbore 74 and provide a sealing passage therethrough from the inlet 74 through the outlet 78.

Other common features associated with the adapters 30 include a flange 82 in the form of a cylindrical shaped plate 75 encircling the body section 72 which is positioned approximately midway between the inlet end 76 and the outlet end 78 and extending radially from the body section 52. The flange 82 includes a top surface 84 and a bottom surface 86. In the embodiment shown, the flange 82 is in the form of a disc. Equally spaced radial ribs 88 and 90 are positioned on the top surface 84 and extend radially from the axis 80 outwardly to the edge of the flange 82. The ribs 88 and 90 extend from top surface 84 axially to inlet end 76. The design of the flange 82 and the ribs 88 and 90 may be a common design in terms of size and location with respect to all of the adapters.

Each adapter such as adapter 70 in FIGS. 4A-C includes a tubular lower or outlet section 100 which includes lugs projections and/or threads or integrally molded retention lug portions 102 which may be exclusively compatible with a filling port of a particular brand of vehicle or crankcase manifold filling port. The figures depict unique arrays of such threads and/or lugs 102 compatible in each instance with distinct manifold filling port openings which are designed in each instance to interact with the manifold opening filling port to affix and retain the adapter 30 (70) attached in position at the manifold filling port.

An additional aspect of the adapter 30 (70) in each instance is utilization of a seal located beneath or at the flange bottom surface 86 and, in many instances, attached or fitted against the bottom surface 86. For example, FIG. 4 depicts an O ring 110 which is fitted into a channel 112 molded in the lower body section of the adapter 70. In FIG. 6 a gasket such as gasket 120 is fitted against the lower surface 86 of a flange 75. Unique thread projections or radial lugs 122 may be provided with respect to a lower section 124 of the adapter of FIGS. 6A-E. Thus, the adapter or adapters 30 include a series of common features in order to make them useful with the universal funnel construction 20 previously described, but the adapters 30 are customized with respect to use of and incorporation in a manner which enables the combination for service with unique filling ports associated with various crankcase engine manifolds.

Thus, the combination of a funnel construction 20 which is universal in design with an appropriate select nozzle section 24 and a multiple set of adapters 30, each of which is designed for utility with respect to specific filling ports for oil of internal combustion engine crankcases, enables by design of the adapters 30 as well as the design of a generally universal funnel filling construction 20 to provide a device which can be easily used and manipulated by technicians and mechanics to service a plethora of motor vehicles efficiently and timely.

FIGS. 7A-C illustrate a 45° elbow adapter 198 which includes a throughpassage 200 having an internal frustoconical pitch angle at a top end thereof. Thus, the nozzle 50 and throughpassage nozzle 200 of elbow adapter 198 may be joined to preclude oil spillage. The adapter 198 is useful with respect to filling ports that are not easily accessed. Thus the elbow 198 provides an additional possible combination using an elbow 198 which may be coupled to an adapter 30 or for pouring into a port opening to preclude spillage as efficiently as the various combinations which employ adapters 30 which thread into a filling port.

In review, a funnel section 22 includes an inlet 36 or top end and an outlet or discharge end with a cylindrical surface that incorporates fastening means such as external threads 48. The funnel section 22 is designed to be compatible with a nozzle section 24 or assembly having a through passage with an inlet and an outlet. The inlet includes an inner surface with cooperative threads 42 or fasteners compatible with the external fasteners or threads 48 of the funnel section 22 to form a sealed liquid passage into and through the throughbore passage and from a smooth surface configured outlet of the nozzle section 24. The external surface of the nozzle section 24 may include a frustoconical outer surface nozzle outlet having a configuration and size which is sealingly compatible with one or more crankcase filling port adapters which receive fluid through the funnel section 22 and nozzle section 24 by flow into an adapter (30) inlet opening. The nozzle section 24 outlet end 50 is compatible with one or more adapters in a collection or kit of adapters.

The kit may further include substitute or alternate nozzle sections 24 having said inlet (thread) configuration and size for engagement to a funnel section having a distinct or separate outlet section size and configuration compatible with a distinct set of adapters. The kit may include a unique set of nozzle sections 24 compatible with a distinct funnel section 22 outlet and/or a distinct set of adapters having unique and different adapter inlets. In each instance, the utilization of a kit with interconnectable cylindrical members of a funnel section and nozzle section projecting from a funnel section and a compatible nozzle section inlet with fasteners such as threads supports efficient vehicle servicing.

Thus, the apparatus of the invention is comprised of a funnel section and one or more unique nozzle sections which, in turn, are compatible with one or more distinct filling port unique adapters. This combination enables the use of a funnel of universal design for and with adapters of distinct design. Among the advantages of the product design is the ability to utilize a single funnel of a large capacity with multiple types and styles of adapters and to further include fluid delivery from a funnel through fluid inlet ports of distinct designs and difficult to access.

While there has been set forth an embodiment of the invention, it is to be understood that the invention shall be limited only by the following claims and equivalence thereof.

What is claimed is:

1. A multi-application oil funnel kit for mitigation of oil spills when filling an internal combustion engine crankcase oil filling port including the type which may incorporate a baffle cover, said kit comprising, in combination:

a funnel construction, said funnel construction including a generally frustoconical funnel having an outer surface, an axis, an open inlet top end, an outlet lower end opening and an integral, cylindrical tubular section longitudinal extending axially from the funnel outlet end with a cylindrical, coaxial external threaded surface, said cylindrical section, encircled by a flange on the funnel surface transverse to the axis, said cylindrical section including an axial throughbore;

a separately detachable nozzle section, said nozzle section consisting of a singular tubular form with an inlet end, a nozzle throughbore passage through the tubular form with an inlet end fastener section generally coextensive with and attachable to the funnel section cylindrical surface by cylindrical internal fastener coextensive threads in the inlet end section of the nozzle throughbore passage, said nozzle section further including an axially transverse surface flange at the inlet of the inlet end of the fastener section for sealing engagement with the funnel connection surface flange, said nozzle section throughbore passage further including a tubular outlet connection section with an outlet opening extending axially from the nozzle fastener section, said nozzle section tubular outlet connection section including an outer frustoconical surface extending axially away from said nozzle detachable section through the said opening with a pitch angle in the range of about 2° to 5° from the axis, and said kit further consisting of two or more separate, distinct filling port adapters, each adapter including a central body section, each adapter body section including an adapter throughbore, said adapter throughbore including an entry end top opening and a discharge end bottom outlet, said adapter throughbore further including a central axis configured with an entry section extending axially into the throughbore configured with an inverse pitch angle, said inverse pitch angle substantially equal in configuration and pitch to the said pitch angle of said nozzle outlet section to effect sealing receipt of said nozzle section by a said adapter, each adapter including a distinct entry port configuration for coupling with an entry port.

2. The kit of claim 1 wherein each said adapter includes a circumferential, generally flat flange extending transversely to the axis and laterally from the body section with a generally flat planar bottom surface facing the adapter bottom outlet, and a top surface of said flange substantially midway intermediate the top opening and bottom outlet.

3. The kit of claim 1 wherein each said adapter further includes at least two equally spaced axial ribs on the top side of the flange extending axially from the body section, said body section including a bottom generally cylindrical filling port engaging end position intermediate the bottom surface of the flange and the bottom outlet, said filling port engagement end of each adapter including a unique pattern of radial filling port projections integrally formed on the engaging end; and an annular seal member retained on the engagement end capable of sealing the engagement end inserted into a compatible filling port.

4. The kit of claim 1 including a plurality of nozzle sections wherein said inside surface fastener assemblies are substantially identical and the outlet of each said nozzle section are a distinct configuration and size.

* * * * *